US006186662B1

(12) United States Patent
Jackson

(10) Patent No.: US 6,186,662 B1
(45) Date of Patent: Feb. 13, 2001

(54) WEIGHTED BAG

(76) Inventor: Steven Ray Jackson, 16881 E. Maglitto, Tomball, TX (US) 77375

( * ) Notice: Under 35 U.S.C. 154(b), the term of this patent shall be extended for 0 days.

(21) Appl. No.: 09/351,596

(22) Filed: Jul. 12, 1999

Related U.S. Application Data

(60) Provisional application No. 60/092,540, filed on Jul. 13, 1998.

(51) Int. Cl.[7] ..... B65D 30/06; B65D 33/10; B65D 33/25

(52) U.S. Cl. ..... 383/16; 383/25; 383/66; 383/117

(58) Field of Search ..... 383/117, 66, 25, 383/16

(56) References Cited

U.S. PATENT DOCUMENTS

| | | | | |
|---|---|---|---|---|
| 403,928 | * | 5/1889 | Emeric | 383/117 |
| 1,725,864 | * | 8/1929 | James | 383/117 |
| 2,040,559 | * | 5/1936 | Luttrell | 383/95 |
| 2,253,688 | * | 8/1941 | Collins | 383/117 |
| 2,390,423 | * | 12/1945 | Carter | 383/117 |
| 2,510,186 | * | 6/1950 | Marsico et al. | 383/117 |
| 2,552,443 | * | 5/1951 | Molinari | 383/117 |
| 2,557,517 | * | 6/1951 | Scruggs | 383/117 |
| 2,616,467 | * | 11/1952 | Cicero | 383/16 |
| 2,617,569 | * | 11/1952 | Sommer | 383/117 |
| 2,897,863 | * | 8/1959 | Somers, Jr. | 383/117 |
| 3,653,660 | * | 4/1972 | Malhas | 273/29 A |
| 3,997,159 | * | 12/1976 | Malhas | 273/29 A |
| 4,010,785 | | 3/1977 | Patik | 150/7 |
| 4,713,033 | * | 12/1987 | Cameron | 441/84 |
| 4,812,054 | * | 3/1989 | Kirkendall | 383/66 |
| 4,979,833 | | 12/1990 | Cook | 383/12 |
| 5,050,999 | * | 9/1991 | Van Loon | 383/117 |
| 5,401,101 | * | 3/1995 | Wang | 383/117 |
| 5,413,199 | | 5/1995 | Clement | 190/108 |
| 5,511,846 | | 4/1996 | Fuller | 294/149 |
| 5,529,204 | * | 6/1996 | Sykes | 43/55 |
| 5,651,455 | | 7/1997 | Garcia | 206/287.1 |
| 5,692,660 | | 12/1997 | Stewart | 224/581 |
| 5,961,426 | * | 10/1999 | Spector | 482/83 |

* cited by examiner

*Primary Examiner*—Stephen P. Garbe
(74) *Attorney, Agent, or Firm*—Robert W. Strozier

(57) ABSTRACT

The present invention provides a simple, durable, light weight and washable bag with a weighted bottom and an elastic opening. The bag of the present invention is designed to hold gear, clothing, groceries, trash or other articles, especially under windy circumstances, and ideally suited for use in boats or other vehicles.

15 Claims, 4 Drawing Sheets

WEIGHTED BAG

RELATED APPLICATION DATA

The present application claims priority of U.S. provisional patent application Ser. No. 60/092,540 filed Jul. 13, 1998.

BACKGROUND OF THE INVENTION

1. Field of the Invention

The present invention relates to bags and to methods of making and using bags. In another aspect, the present invention relates to weighted bags and to methods of making and using such bags. In even another aspect, the present invention relates to weighted mesh bags for use under windy conditions and to methods of making and using such mesh bags.

2. Description of the Related Art

The containment of trash and other articles is an important part of controlling pollution and protecting the environment. Preventing trash, gear, clothing, groceries and other items from being lost or scattered, is especially difficult under windy conditions as would be encountered generally, or especially as in a moving vehicle such as a car, truck or boat.

There have been several attempts in the prior art to provide for articles for containing trash and gear.

U.S. Pat. No. 4,010,785 to Patik discloses a generally rectangular bag constructed of mesh material to receive and contain personal clothing for washing. The bag of the '785 patent includes front and rear mesh panels of generally rectangular configuration with corresponding longitudinal edges of the panels secured together and one pair of corresponding end edges of the panels secured together. The other end edge of one of the panels includes an end extension flap which is folded back over the corresponding end marginal edge of the other panel and the opposite side edges of the flap are sewn to the corresponding longitudinal end edges of the bag. In addition, the opposite end portions of the end marginal edges of the panels at the flap end of the bag and the corresponding overlying portions of the flap are secured together by sewing, thereby leaving only central portions of the end edges of the panels closed by the flap open for insertion of personal clothing into the bag beneath the flap and withdrawal of washed clothing from the bag.

U.S. Pat. No. 4,979,833 to Cook discloses a bag structure having a semirigid drawstring closure which passes through a hollow handle. The semirigid drawstring holds the mouth of the bag open so that articles can be easily deposited. A shoulder strap is attached to the handle. The shoulder strap and handle are provided for carrying as well as suspending the bag. A flexible tubular material partially inverted creates the double wall of the bag and a fold at the bag mouth. The fold contains the drawstring and the handle, and an additional seam is not required to encase the drawstring. The flexible tubular material is preferably a mesh. Mesh provides a strong bottom seam which is preferably created by lacing a cord through the mesh openings in the four layers of material.

U.S. Pat. No. 5,413,199 to Clement discloses an equipment bag having a first closable opening and having a strap presenting handles for carrying. The outer bag of the '199 invention has an open top and a fastener means extending thereabout. An inner mesh sack is releasably securable within the outer bag. The inner mesh sack includes a top panel having a second closable opening and a plurality of side panels and a bottom panel. The plurality of side panels and bottom panels are made of mesh material. The top panel has a complementary fastener extending thereabout for joining with the fastener for closing the open top when the inner mesh sack is within the outer bag. Equipment is storable within the inner mesh sack and the inner mesh sack is removable from the outer bag for facilitating air to pass therethrough.

U.S. Pat. No. 5,511,846 to Fuller discloses a carrier for a scuba tank having a nipple end and a bottom end and being of a specific size includes a porous bag open at one and sized to be snugly fitted ono the scuba tank from over the bottom end of the scuba tank. A closure for the open end of the bag permits selective opining and closing of the open end, and a strap has a first portion sewn to the bag and encircling relation to at least a portion of the bag and handle portion. The fabric bag can be snugly fitted onto the scuba tank from over the bottom end of the scuba tankg, the open end of the bag can be closed by the closure and the combined scuba tank and bage may be conveniently carred using the strap handle portion as a handle, with the first portion of the strap providing support for the tank. The carrier of the '846 patent has a woven nylon bottom to provide abrasion resistance and an upper portion as mesh fabric allowing for carrier to remain on the tank during a dive.

U.S. Pat. No. 5,651,455 to Garcia discloses an accessory bag of generally rectangular configuration ans having flexible front and back members. The back member is formed of a generally imperforate flexible material with the front member having a like configuration ans form of an open mesh flexible material with as substantial portion of the periphery thereof secured together. A zipper or the like is attached to the balance of the periphery. The upper and lower edges of opposites sides of the mesh surface are provided with mating fasteners such as Velcro strips or snaps at positions suitable for enabling coupling of the fasteners to one another with the bag folded with the back member exposed. The mesh material has the openings thereof sufficiently large for enabling insertion of a finger therethrough, whereby the bag may be utilized for small articles such as small clothing items, hair pieces, scarves or the like, which may be viewed through and extracted through the openings of the mesh material by use of a finger without opening the bag. The articles may be partially removed for display as desired. For purpose of hanging the bag, one edge is provided with a pivotably or retractable hook or hanger member, while the opposite edge is provided with a strap or handle to permit carrying the bag.

U.S. Pat. No. 5,692,660 to Steward discloses an article carrying bag including a first bag having a top defining a first bag opening, a closed bottom, and a central body portion extending between the top and bottom, a second bag having a top defining a second bag opening, a bottom and a central body portion extending between the top and bottom, and a joinder line connecting the top of the first bag adjacent the bottom of the second bag such that the bags are capable of being configured in plural configurations including one in which the first bag extends away from the second bag and both openings face the same direction for defining a singular enclosure for receiving and holding articles, and another configuration in which the first bag may be stuffed into the second bag so the bag openings face opposite directions for defining separate enclosures for receiving and holding articles. Each separate enclosure prevents its respective held articles from commingling with articles in the other enclosure. A closure member is preferably connected adjacent each bag top for enabling one or both of the bangs to be closed. Preferably, the closure member includes an elongate strap and a collar which is connected adjacent at least one o fthe bag tops for receiving a portion of the strap which permits the bag top to be gathered therealong for closing. In the preferred embodiment, two collars are provided, the first bag is waterproof or water resistant, and the second bag is mesh.

Despite the advances of the prior art there is still a need for a article container or bag that does not suffer from the deficiencies of the prior art, and for methods of making and using such bags.

There is another need in the art for a rugged, durable and easy to manufacture bag capable of securely holding articles or trash under windy conditions, and for methods of making and using such containers.

These and other needs in the art will be come apparent to one of skill in the art upon review of this specification, its claims and drawings.

SUMMARY OF THE INVENTION

It is an object of the present invention to provide an article container or bag which does not suffer from the disadvantages of the prior art and to provide methods of making and using such a container.

It is another object of the present invention to provide a rugged, durable and easy to manufacture bag capable of securely holding articles or trash under windy conditions, and for methods of making and using such containers.

These and other objects of the present invention will become apparent to those of skill in the art upon review of this patent specification, claims and drawings.

According to one embodiment of the present invention there is provided a bag having an upper portion defining a bag opening, a constrictor encircling at least a portion of the opening, and a weighted lower portion connected to the upper portion.

According to another embodiment of the present invention there is provided the bag as described above further including a mesh middle portion attached between the upper and lower portions.

According to even another embodiment of the present invention there is provided the bag as described above further including a fastener running lengthwise along one side of the bag.

These and other embodiments of the present invention will become apparent to those of skill in the art upon review of this patent specification, claims and drawings.

DETAILED DESCRIPTION OF THE INVENTION

The present invention provides a simple bag with a weighted bottom and an elastic constricted opening, which is useful to hold gear, clothing, groceries, trash or other articles, especially under windy circumstances. The bag of the present invention is lightweight, washable and ideally suited for use outdoors and in boats or other vehicles.

One embodiment of the bag of the present invention will be discussed by reference to FIGS. 1–5. It should be understood that bag 1, shown in FIGS. 1–5, is merely one embodiment of the present invention, and that the present invention should not be thought of as limited to the particular bag 1 illustrated in the figures.

Referring now to the figures, the bag of the present invention will be shown and described in detail. Like numbers will be used to refer to like components throughout the discussion of the figures.

Figure 1:
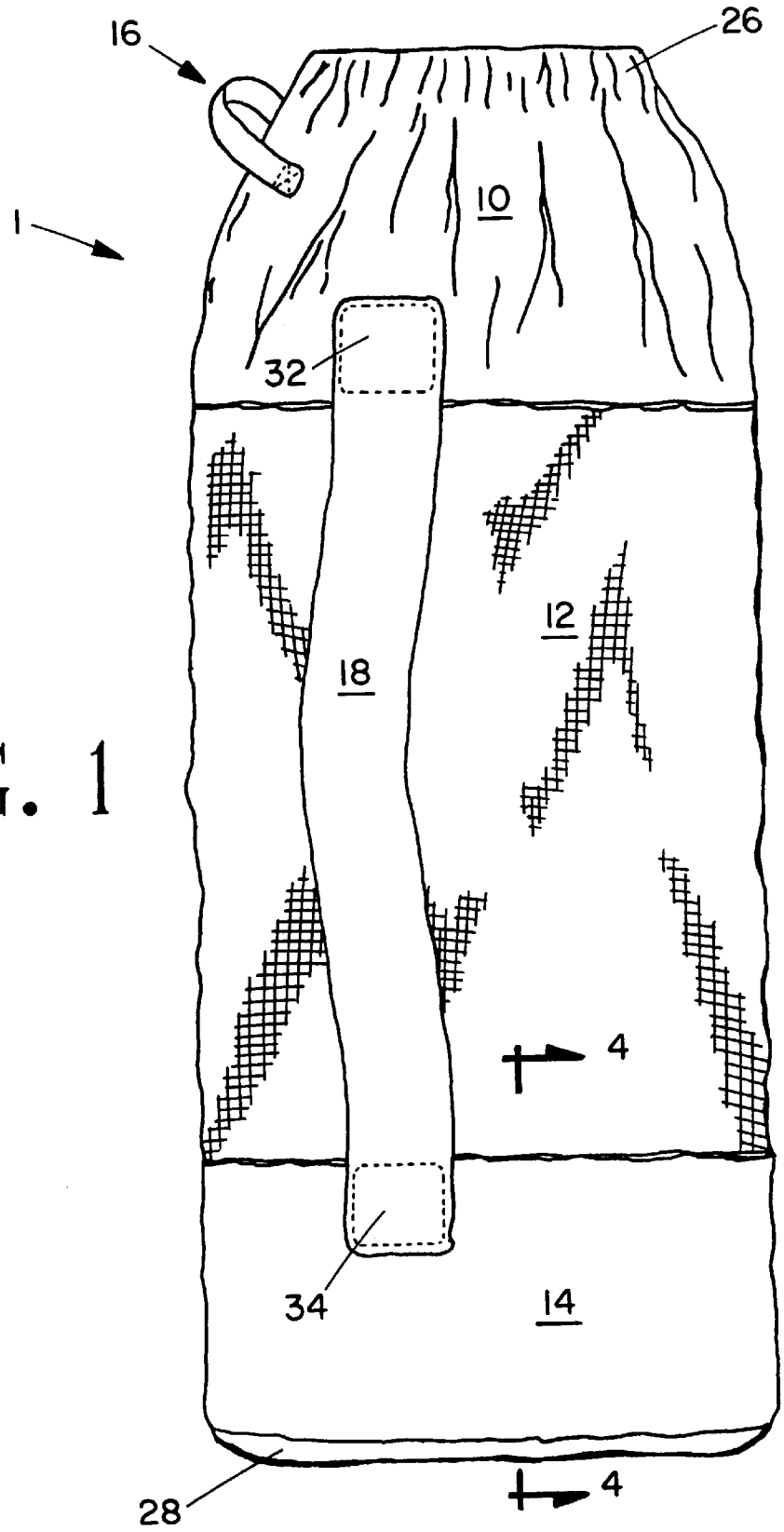
FIG. 1 is a front elevation view of one embodiment of container 1 of the present invention showing upper section 10, middle section 12 and lower section 14, weighted pouch 28, hanging loop 16 and carrying strap 18.
Figure 2:
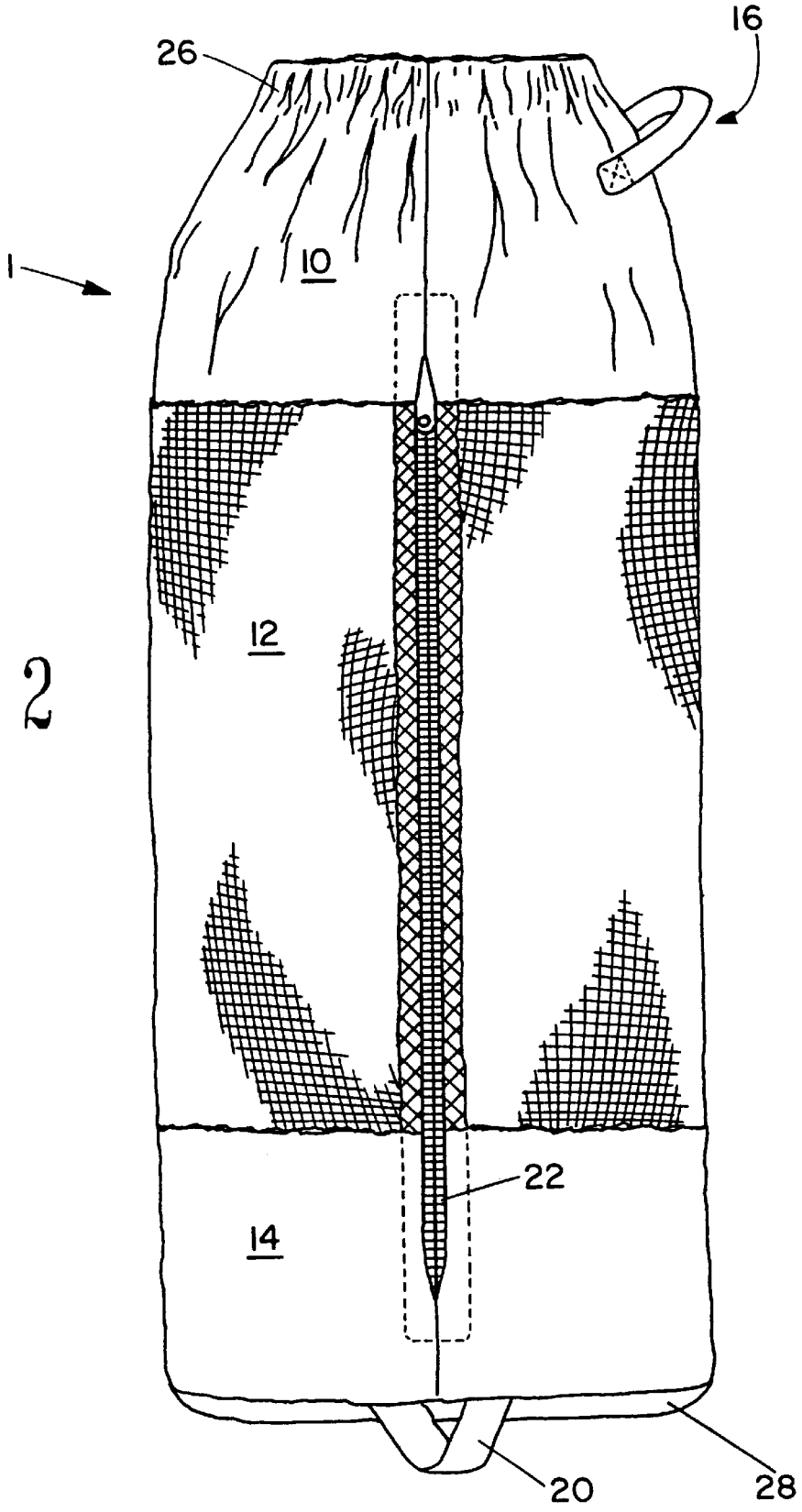
FIG. 2 is a rear elevation view of container 1 of FIG. 1 showing hanging loop 20 and zipper 22.

Referring to FIGS. 1 and 2, there are a front and rear elevation view respectively of one embodiment of the bag, shown generally as 1, of the present invention. Bag 1, generally includes upper section or portion 10, middle section or portion 12, lower section or portion 14, upper hanging loop 16, carrying strap 18, lower hanging loop 20 and zipper 22.

Bag 1 is constructed of upper portion 10 middle portion 12 and lower portion 14. Sections 10, 12 and 14 are secured together or integral with each other to form bag 1, with upper portion 10 defining bag opening 24 and with lower portion 14 forming the bottom of bag 1. Bag 1 may be manufactured in any useful or convenient size.

Although bag 1 is shown in the figures to have a generally cylindrical configuration with a somewhat circular cross-sectional area, it is understood that bag 1 may have any functional configuration or cross-sectional area. Non-limiting examples of suitable configurations include cylindrical, block, cube, pyramidal, and combinations thereof. Non-limiting examples of suitable cross-sectional areas include circular, oval, triangular, square, rectangular, polygonal and combinations thereof.

Upper portion 10, middle portion 12 and lower portion 14 may be made of any fairly inelastic material and in practice any suitable material may be used. Preferably, bag sections 10 and 14 are made of a washable material and more preferably made of cloth, nylon, Nomex, Kevlar, canvas, a canvas type material or combinations thereof. Optionally, sections 10 or 14 are made of a water proof or water resistant material.

Preferably, middle section 12 is made of any open weave mesh, a netting material, or other suitable material to allow for air circulation throughout bag 1 and to facilitate crushing of bag 1 for packing, transporting or storing. Any suitable size and weight of mesh may be utilized to form middle section 12.

Bag 1, also includes fastener 22. Fastener 22 may be any fastening means, but is preferably a zipper running lengthwise along one side of bag 1. Fastener 22, when opened, facilitates the emptying of trash or the unpacking of articles contained in bag 1.

Bag 1 includes carrying strap 18 which is a conventional carrying strap sewn or otherwise attached to bag 1. Strap 18 is made of a fairly inelastic material and in practice any suitable material may be used. Strap 18 must be of sufficient strength to support the weight of bag 1 and its contents while being transported. Preferably, a first end 32 of strap 18 is secured to upper portion 10 and a second end 34 of strap 18 is attached to lower portion 14. Preferably, strap 18 is made of cloth, nylon, Nomex, Kevlar, canvas or a canvas type material.

Bag 1 may also include upper hanging loop 16 and lower hanging loop 20 sewn or otherwise attached to bag 1.

Hanging loops 16 and 20 are made of a fairly inelastic material and in practice any suitable material may be used. Preferably, loops 16 and 20 are made of cloth, nylon, canvas or a canvas type material. Preferably, loop 16 is secured to upper section 10 and loop 20 is secured to lower section 14. The purposes of loops 16 and 20 include providing hangers for bag 1 during use or after washing.

Figure 3:
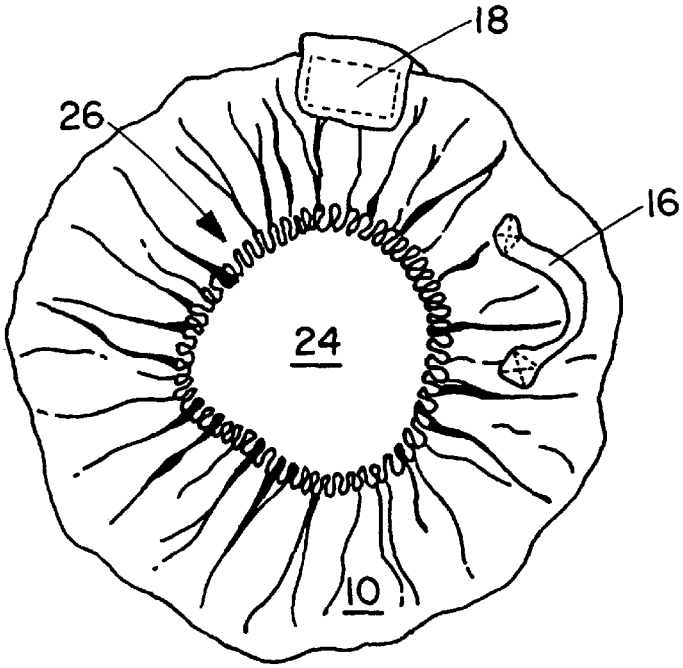
FIG. 3 is a top view of container 1 of FIG. 1 showing opening 24 and elastic band 26.

Referring now to FIG. 3 there is shown a top view of bag 1 having constrictor 26 in upper section 10. Constrictor 26 constricts opening 24 and may be separate from or integral with section 10 of bag 1. Constrictor 26 may be any suitable means to aid in the closure or constriction of opening 24. Non-limiting examples of suitable constrictors 26 include an elastic band, a drawstring, a clasp, a clamp, buttons or the like. Preferably, constrictor 26 is an elastic band positioned or sewn into a hem formed in upper section 10. Constrictor 26 gathers the material of section 10 to form constricted opening 24. The purpose of constrictor 26 is to close or partially close opening 24 defined by upper section 10 to contain debris or other items placed within bag 1.

Figure 4:
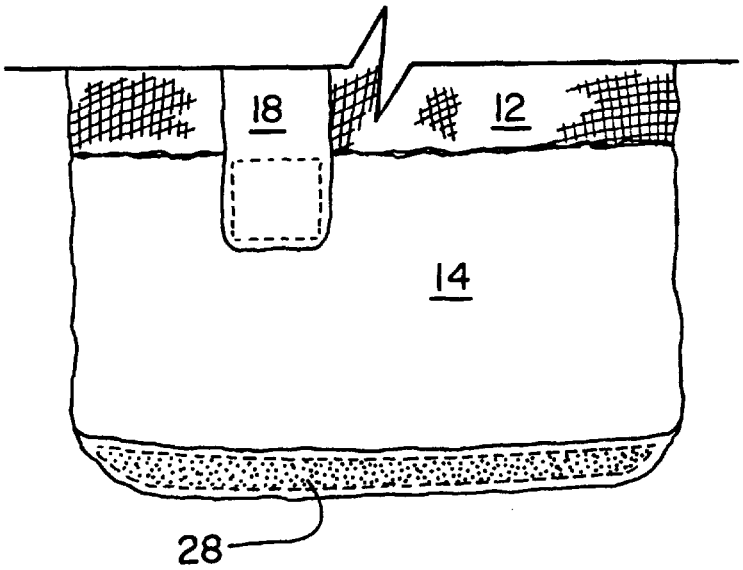
FIG. 4 is a view of lower section 14 of FIG. 1 showing sand pouch 28.

Referring now to FIG. 4, there is shown a view of lower section 14 of bag one having weight 28 incorporated therein. Weight 28 may be separate from or integral with section 14 of bag 1. Weight 28 may be of any desired mass sufficient to prevent bag 1 of a given size from being blown about under windy conditions. Weight 28 may be any suitable object placed into bag 1 so as to weigh bag 1 down sufficient to prevent it from being blown about. Non-limiting examples of suitable weight 28 include sand, beads, rubber, metal. Preferably, weight 28 is a pouch containing sand positioned in, sewn into or otherwise attached or placed in lower section 14. The purpose of weight 28 is to weigh down the bottom of bag 1 so that the bag and contents will remain in place under windy conditions such as would be encountered in a moving vehicle or boat, or which may be encountered at the beach, in the yard or park or otherwise outdoors.

Optionally the bottom outside portion of lower section 14 may include a non-skid surface. Also optionally, bag 1 may be provided with a floatation means such as an air bladder or foam collar so as to prevent bag 1 from sinking.

Figure 5:
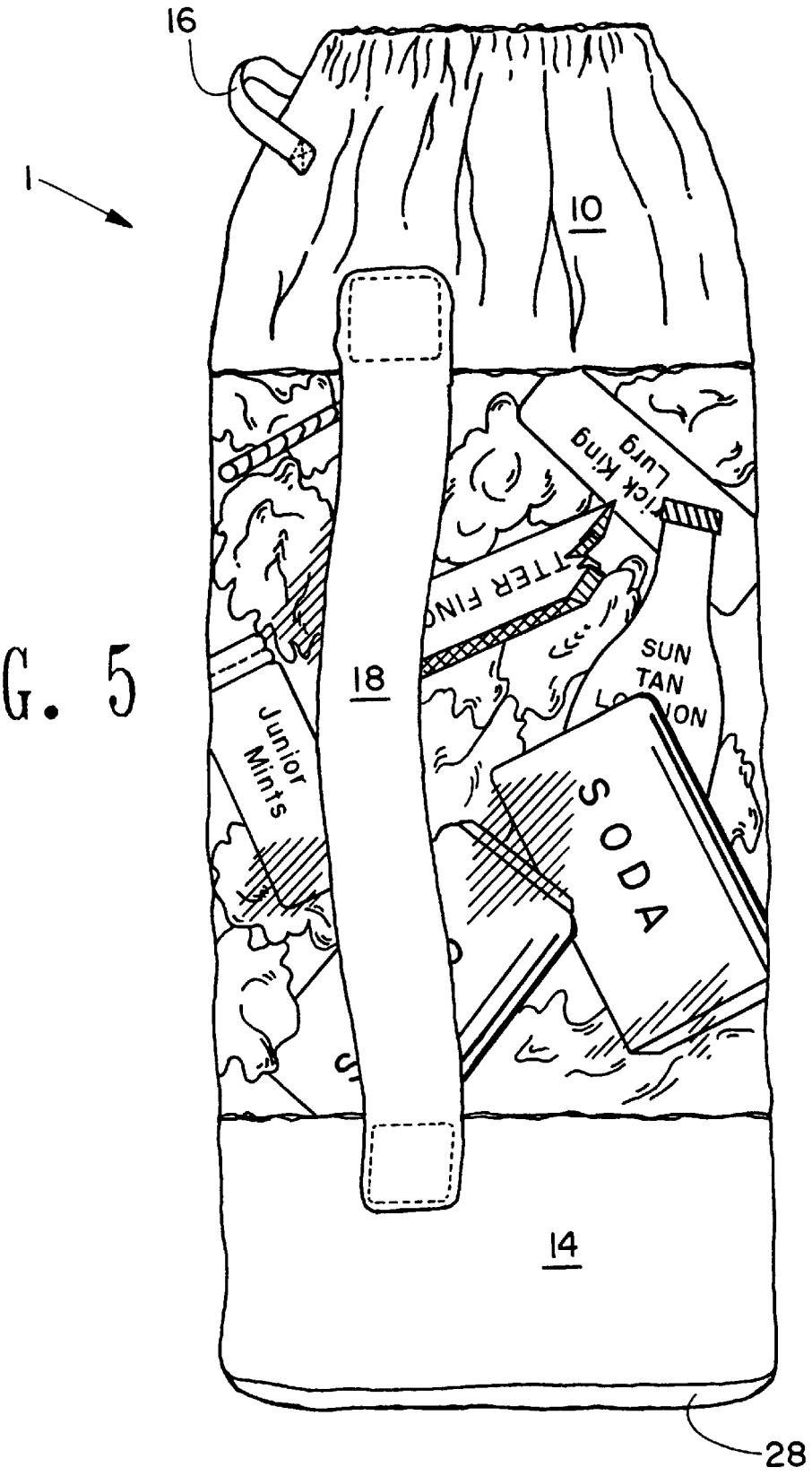
FIG. 5 is a front elevation view of showing container 1 of FIG. 1 with trash 50.

In the use of bag 1, constrictor 26 is stretched or otherwise opened to increase the size of opening 24. A a piece of trash or other item is then placed into the interior of the bag. After inserting the item, the constrictor is closed, or allowed to contract to partially close opening 24, so as to trap the item inside. Referring now to FIG. 5, there is an illustration of bag 1, shown with the mesh of middle section 12 cut away, with trash 50 trapped inside. To empty bag 1, fastener 22 is opened to expose the interior and to allow the contents to be easily removed.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled the art to which this invention pertains.

I claim:

1. A bag comprising:

a) an upper bag portion defining a bag opening;

b) a constrictor encircling at least a portion of the opening;

c) a middle portion comprising mesh and connected to a lower section of the upper portion;

d) a lower portion connected to a lower section of the middle portion wherein the lower portion further comprises a weight comprising a sand pouch; and e) a fastener running lengthwise along a side of the bag.

2. The article of claim 1 further comprising a carrying strap attached to a side of the bag.

3. The article of claim 1 wherein the upper and lower bag portions comprise a material selected from the group consisting of cloth, nylon, Nomex, Kevlar, canvas, a canvas type material and combinations thereof.

4. The article of claim 1 wherein the bag has a general cross-sectional area selected from the group consisting of circular, oval, triangular, square, rectangular, and polygonal.

5. A bag comprising:

a) an upper portion defining a bag opening;

b) a constrictor encircling at least a portion of the opening;

c) a middle portion comprising mesh and attached to a lower section of the upper portion; and d) a lower portion connected to a lower section of the middle portion wherein the lower portion further comprises a pouch located in a bottom of the lower bag portion and filled with sand, beads, rubber or metal; and e) a fastener which runs lengthwise along a side of the bag.

6. The bag of claim 5 further comprising a fastener which runs lengthwise along a side of the bag.

7. The bag of claim 5 further comprising a carrying strap attached to a side of the bag.

8. The bag of claim 5 wherein the upper and lower bag portions comprise a material selected from the group consisting of cloth, nylon, Nomex, Kevlar, canvas, a canvas type material and combinations thereof.

9. The bag of claim 5 wherein the bag has a general cross-sectional area selected from the group consisting of circular, oval, triangular, square, rectangular, and polygonal.

10. The bag of claim 5 wherein the pouch is filled with sand.

11. A bag comprising:

a) an upper portion defining a bag opening;

b) a constrictor encircling at least a portion of the opening;

c) a middle portion comprising mesh and connected to a lower section of the upper portion;

d) a lower portion connected to a lower section of the middle portion;

e) a fastener running lengthwise along a side of the bag; and f) a separate weight placed in the lower portion and comprising a pouch filled with sand, beads, rubber or metal.

12. The bag of claim 11 further comprising a carrying strap attached to a side of the bag.

13. The bag of claim 11 wherein the upper and lower bag portions comprise a material selected from the group consisting of cloth, nylon, Nomex, Kevlar, canvas, a canvas type material and combinations thereof.

14. The bag of claim 11 wherein the bag has a general cross-sectional area selected from the group consisting of circular, oval, triangular, square, rectangular, and polygonal.

15. The bag of claim 11 wherein the pouch is filled with sand.

* * * * *